US012741193B2

(12) United States Patent
Savolainen et al.

(10) Patent No.: US 12,741,193 B2
(45) Date of Patent: Sep. 22, 2026

(54) BORDER ELEMENT ARRANGEMENT

(71) Applicant: VEPE-ICEPRO OY, Ylivieska (FI)

(72) Inventors: Henri Savolainen, Tuusula (FI); Joni Moilanen, Lahti (FI); Janne Syvänen, Helsinki (FI)

(73) Assignee: Vepe Oy Peltonen, Tuusula (FI)

( * ) Notice: Subject to any disclaimer, the term of this patent is extended or adjusted under 35 U.S.C. 154(b) by 823 days.

(21) Appl. No.: 17/903,411

(22) Filed: Sep. 6, 2022

(65) Prior Publication Data

US 2023/0090087 A1 Mar. 23, 2023

(30) Foreign Application Priority Data

Sep. 7, 2021 (FI) ..... 20215941

(51) Int. Cl.
*A63C 19/10* (2006.01)

(52) U.S. Cl.
CPC ..... *A63C 19/10* (2013.01)

(58) Field of Classification Search
CPC .... A63C 19/00; A63C 19/10; A63C 2019/085
USPC ..... 472/61, 90–94
See application file for complete search history.

(56) References Cited

U.S. PATENT DOCUMENTS

| | | | | |
|---|---|---|---|---|
| 6,698,121 | B2 * | 3/2004 | Wardle | G09F 9/33 40/550 |
| 11,150,855 | B2 * | 10/2021 | Monsees | F16M 13/02 |
| 2013/0074538 | A1 * | 3/2013 | Forsberg | G09F 19/228 362/249.02 |
| 2016/0210104 | A1 * | 7/2016 | Welck | A61B 5/1128 |
| 2017/0326435 | A1 * | 11/2017 | Schleuniger | A63C 19/10 |

* cited by examiner

*Primary Examiner* — Eugene L Kim
(74) *Attorney, Agent, or Firm* — Ziegler IP Law Group, LLC.

(57) ABSTRACT

A border element arrangement includes two or more border elements abutting each other side-by-side. The elements have a frame provided with end bars and a structure connecting the end bars at least in the top part and bottom part of the frame, and disposed to be supported by the frame is a digital display that is capable of displaying a moving image. The display has one or more display panels. In both end bars is a recess, inside which the display is disposed at the point of the end bar.

9 Claims, 4 Drawing Sheets

BORDER ELEMENT ARRANGEMENT

FIELD

The aspects of the disclosed embodiments are directed to a border element arrangement. In particular, the border element arrangement according to the disclosed embodiments is suited for use as, inter alia, a border bounding a playing field or competition area, whereby a number of border elements can be connected e.g. end-to-end consecutively to isolate the desired area from its surrounds. One such playing area bounded in this way can be e.g. an ice hockey rink, in which case the border elements are the dasher boards of an ice hockey rink.

BACKGROUND

There are generally many spectators at sports events and some events are also televised, in which case the number of spectators increases significantly. Earlier, e.g. the dasher boards of ice hockey rinks were of one color, essentially a pale color, and devoid of anything else apart from markings associated with the game. However, dasher boards provide a good space for advertisements, so this space has started to be utilized.

Plastic stickers, among other things, which are fastened in a detachable manner to the dasher board, have been used in the advertisements and other notifications of dasher boards. A problem with them, however, is that small pieces of them drop onto the ice dislodged by impacts from hockey pucks and hockey sticks. At the same time also the quality of advertising images deteriorates.

One solution that has been used is a clear and transparent plastic sheet disposed on the inside of the dasher boards of an ice hockey rink, e.g. an acrylic or polycarbonate sheet, with a thin advertising image, advertising text, or an image or color film presenting other information, being situated between the plastic sheet and the surface of the dasher board. One problem with this solution is, however, that the view of the advertisement is static. Another problem is that the advertisements cannot be smoothly changed during the game.

Advertising structures and information structures of the roller blind type have also been disposed in dasher boards. One such is presented in, inter alia, international patent specification no. WO9838623 A1. The solution according to the specification comprises an element which has a transparent window on one side, and disposed inside the frame of the element are two rollers, one above the other, one in the upper section and the other in the lower section of the frame. The structure includes a web containing the information, which can be wound onto the rollers and moved between the rollers. In addition, the element comprises machinery for rotating the rollers. By means of the control system in the element, the desired section of the web can be rotated so as to be visible through the window. A problem in this solution is that the structure is complex and only a limited amount of information fits onto one web. Another problem is that the roller structure of the specification cannot be situated e.g. in the curved corners of an ice hockey rink. Furthermore, the view of the advertisement is static.

Newer prior art is presented in U.S. Pat. No. 6,698,121 B2. The specification discloses digital dasher boards for a sports arena, such as for an ice hockey rink. Each digital dasher board comprises a display panel, which is a perforated board at least the size of the display area, into the apertures of which panel the LEDs in a straight LED cluster are inserted in such a way that the LEDs protrude through the perforated display panel board. Each board-type LED unit has a plurality of LEDs configured in rows and columns. A plurality of LED clusters are fastened to the display panel, side-by-side and one above another, the LEDs of which clusters together form the information area of the display panel. The display panel is fastened at its upper edge and lower edge to support elements provided with a shock absorber, and in front of the LEDs is a transparent protective sheet. The dasher board is very complex in structure and requires precise installation work. Also, for example, replacement of a broken display element and placing it back into the many holes of the display panel is difficult and requires precision, and therefore extra time is used to do this.

SUMMARY

The aspects of the disclosed embodiments are directed to eliminate the aforementioned drawbacks and to provide an inexpensive, simple, operationally reliable border element arrangement that can be rapidly installed and also disassembled. Another purpose is to provide a display panel system forming the whole surface of the border assembly as seamlessly as possible. The border element arrangement according to the disclosed embodiments is characterized by what is disclosed in claim 1. Other embodiments are characterized by what is disclosed in the other claims.

To achieve this purpose, the border element arrangement according to the disclosed embodiments comprises two or more border elements abutting each other side-by-side, the elements comprising a frame provided with end bars and a structure connecting the end bars at least in the top part and bottom part of the frame, and disposed to be supported by the frame a digital display comprising one or more display panels that is capable of displaying a moving image, as well as a protective sheet in front of the display. Preferably both end edges of the display are adapted to extend to the same vertical plane as the outer surface of the positioned end bar.

One advantage of the border element arrangement according to the disclosed embodiments is that by means of the embodiments advertising revenues receivable from the border elements can be multiplied by virtue of the moving image content. Furthermore, the display solution of the border elements enables the use of various special effects e.g. in ice hockey matches or in other events. Another advantage is also that installation and disassembly of the border elements is easy and fast. Yet another advantage is that the digital display according to the invention can also be situated in the curved sections of the border elements, e.g. in the curved sections of an ice hockey rink.

BRIEF DESCRIPTION OF THE DRAWINGS

In the following, the aspects of the disclosed embodiments will be described in more detail by the aid of one example of its embodiments with reference to the simplified and diagrammatic drawings attached, wherein.

DESCRIPTION OF THE EMBODIMENTS

Figure 1:
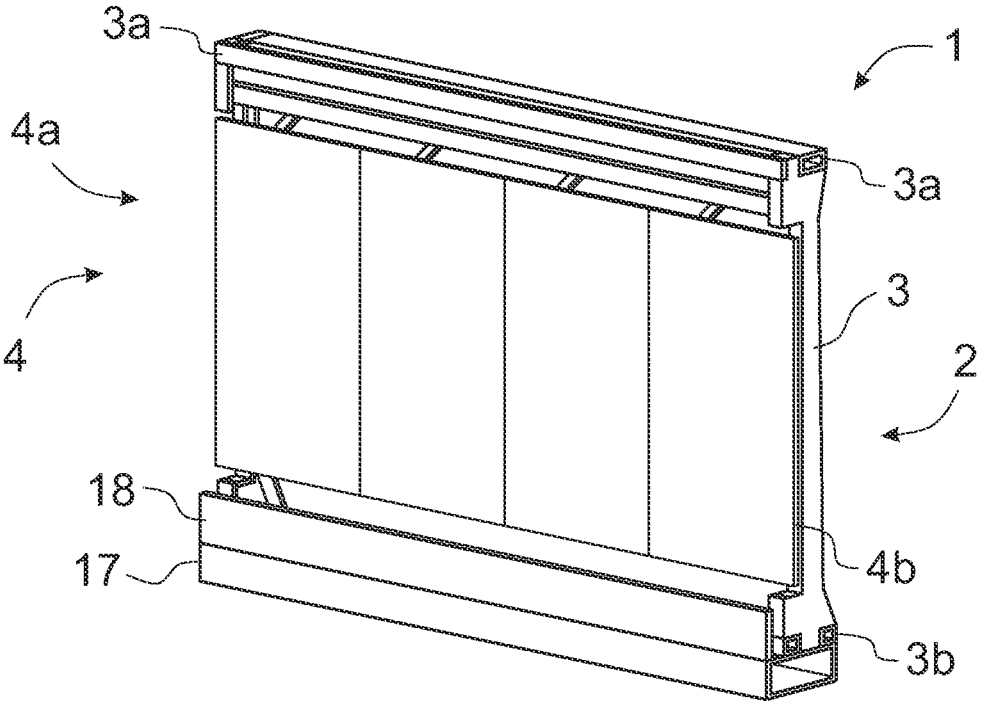
FIG. 1 presents a diagrammatic and simplified view of one border element according to an embodiment as viewed obliquely from the front.

FIG. 1 presents a diagrammatic and simplified view of one border element 1 according to the aspects of the disclosed embodiments as viewed obliquely from the front. The border element 1 comprises a frame 2, which is preferably a ring-shaped structure with top bars 3*a,* bottom bars 3*b* and the end bars 3 connecting these. There can be more than one top bar and more than one bottom bar in a single border element 1. A plurality of display panels 4*a* forming a digital display 4, such as a LED display, are suspended on the frame 2.

Preferably the height of one display panel 4*a* is essentially equal to the height of the whole display area of the border element 1. In addition, the display elements 4*b* of the display panels 4*a* are adapted to be fastened to each other at their end edges, in which case there is no gap between the display elements 4*b* in the assembly of border elements 1 disturbing the information displayed by the display elements 4*b,* except for special border elements, such as e.g. border elements comprising opening gates, in which small gaps are possible at the point of the gates. Preferably the total combined width of the display elements 4*b* is equal to the distance of the outer surfaces of the end bars 3 of the border element 1 from each other. In this case, e.g. the video image to be displayed on the inside of the border of an ice hockey rink is continuous and can move around the border from one dasher board 1 to another seamlessly.

Figure 5:
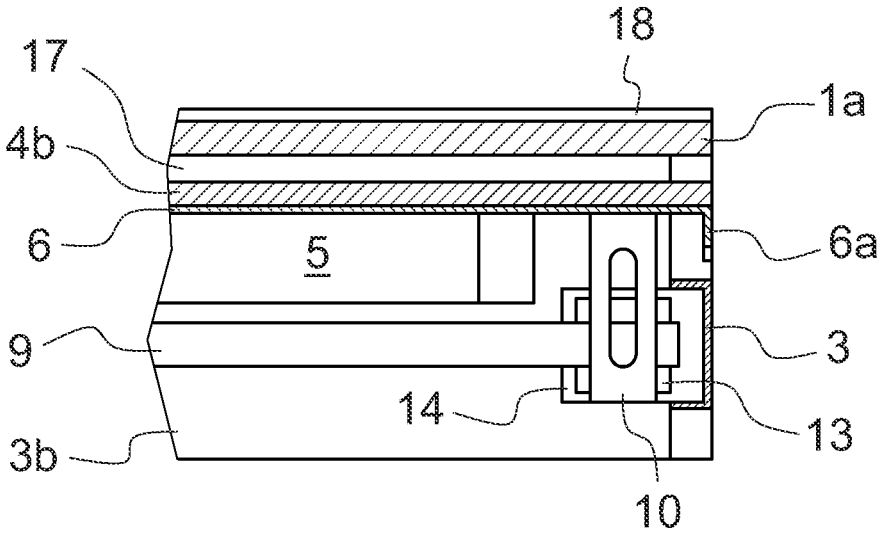
FIG. 5 presents a partly simplified and magnified detail of an end of one border element according to an embodiment, sectioned along the section line A-A of FIG. 7.
Figure 7:
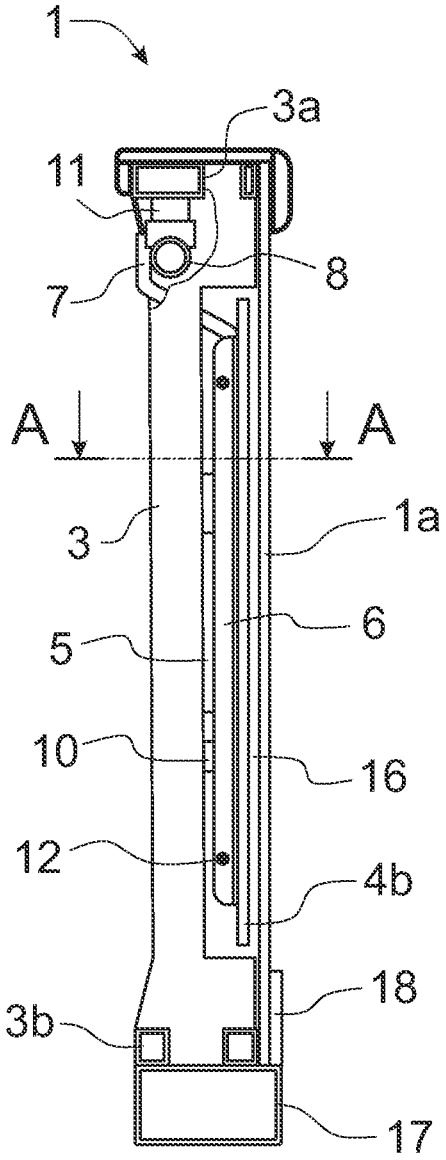
FIG. 7 presents a diagrammatic and simplified view of one border element according to an embodiment as viewed from the end, and an end bar partially sectioned at its top part.

In FIG. 1, the protective sheet 1*a* protecting the display elements 4*b* is missing from the front of the display elements 4*b,* which protective sheet is placed in front of the display 4 in the finished structure and fastened e.g. by riveting to the frontmost top and bottom bar 3*a,* 3*b* of the frame 2 between the frontmost bottom bar 3*b* and the front plate 18. The protective sheet 1*a* shown in FIGS. 2, 5 and 7 is a clear and transparent sheet suitable for the purpose, such as e.g. an acrylic or polycarbonate sheet.

Figure 2:
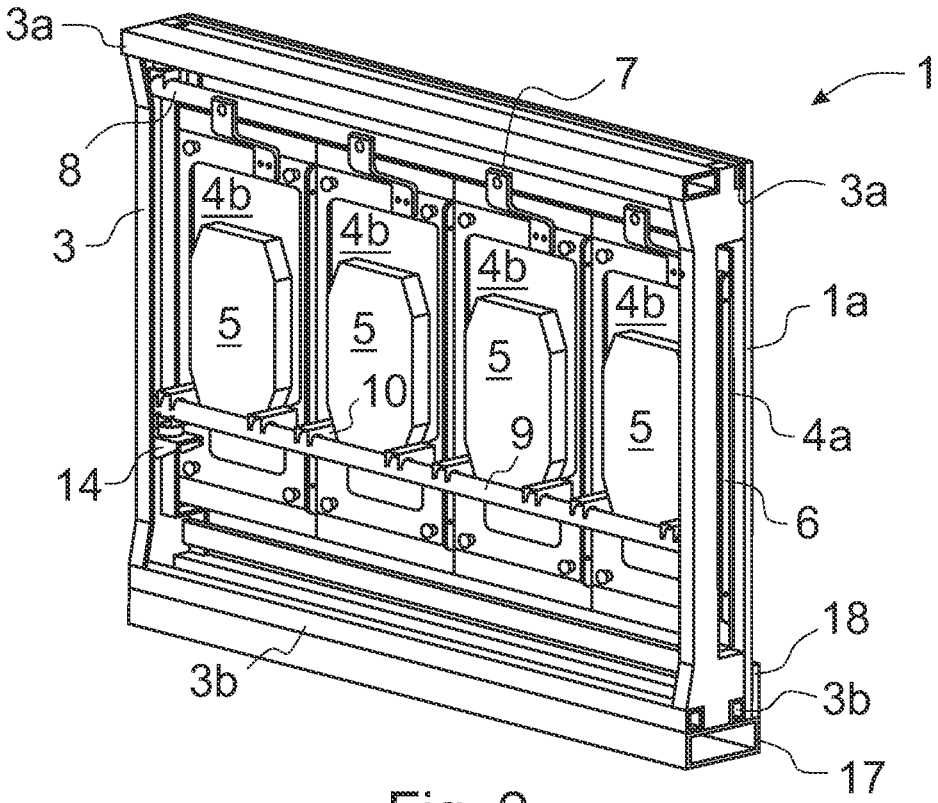
FIG. 2 presents a diagrammatic and simplified view of one border element according to an embodiment as viewed obliquely from the rear.
Figure 3:
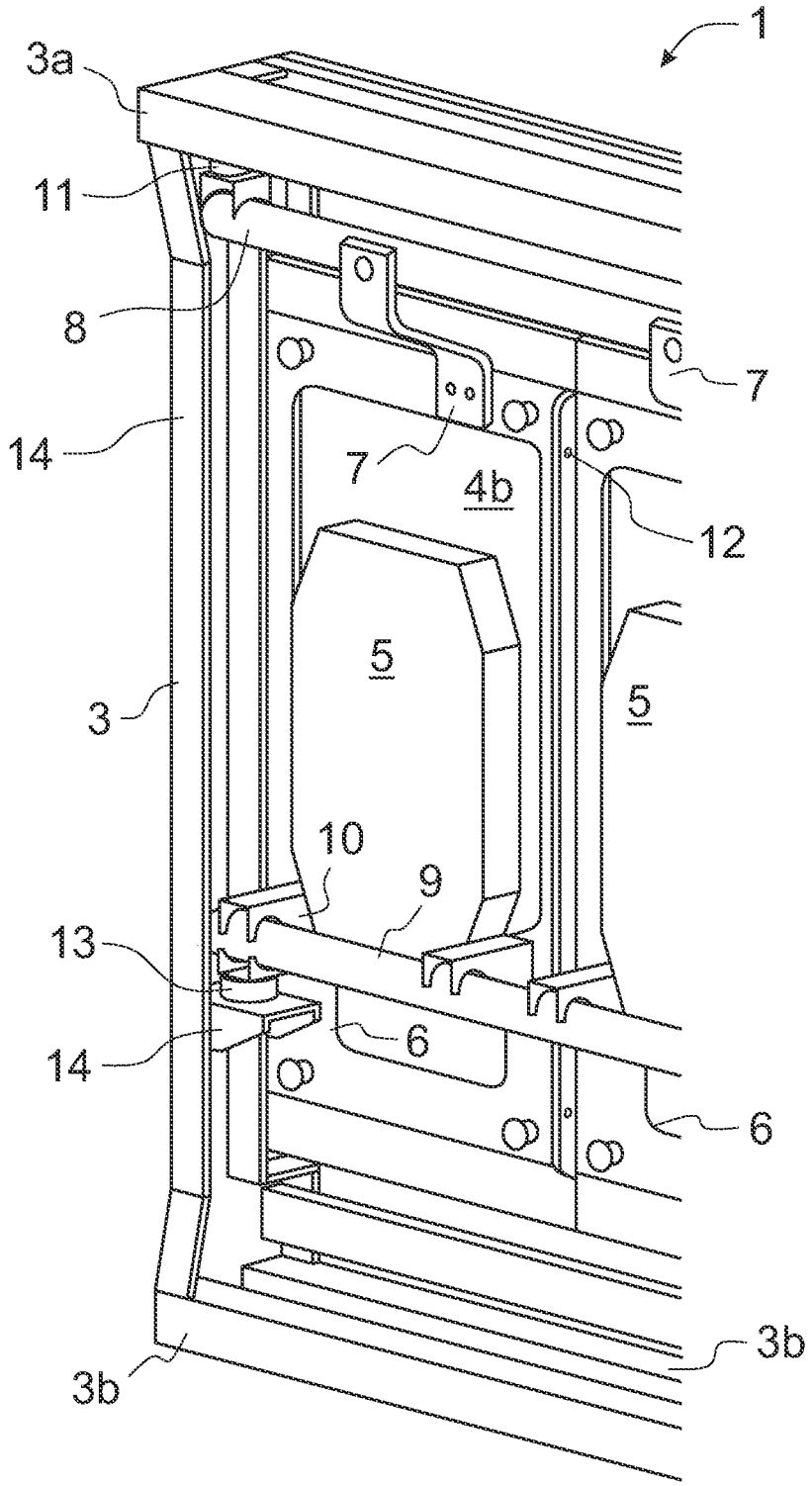
FIG. 3 presents a diagrammatic and simplified rear view of a magnified detail of one end of a border element according to an embodiment as viewed obliquely from above.

FIGS. 2 and 3 present a diagrammatic and simplified view of one dasher board 1 according to the invention as viewed from the rear, in other words e.g. as viewed from outside the ice hockey rink. FIG. 2 presents an oblique rear view from above of the border element 1, and FIG. 3 presents an oblique rear view from above of an enlarged detail of one end of one border element 1 according to the invention, with the top and bottom suspensions of the display panels 4*a*.

Each display panel 4*a* comprises a support frame 6, which is, in turn, fastened by means of suspension means 7 to an essentially horizontal support rod 8 in the upper part of the border element 1. The side edges of the support frame 6 are bent backwards at right angles to the front surface of the support frame 6 in such a way that the side edges form the fastening surfaces for adjacent support frames 6. The support frame 6, with the outer surfaces of its side edges, is preferably as wide as the display element 4*b* fastened to the front side of the support frame 6, i.e. the distance between the outer surfaces of the side edges equals the width of the display element 4*b*. Thus, adjacent display panels 4*a* are easy to fasten seamlessly to each other. When the support frame 6 is as wide as the display element 4*b,* adjacent display panels 4*a* can easily be fastened to each other with tightened fastening means 12, such as screws and nuts, in the fixing holes in the side edges of the support frame 6. The front surface and the front side refer to that side on which the image of the display element 4 is visible. The rear side is the opposite side.

The distance between the outer surfaces of the side edges of the support frame 6 can also be smaller than the width of the display element 4*b*. In this case, a filler of a suitable thickness, e.g. one or more washers or a shim, can be placed between the outer surfaces of the side edges of the support frames 6 of adjacent display panels 4*a* in conjunction with the fastening.

The suspension means 7 of the upper end of the display panel 1 can be e.g. a flat bar fabricated into a suitable shape and bent, which bar advantageously keeps the upper end of the display panel 4*a* in position. The support rod 8 is placed in the upper part of the frame 2 of the border element 1 between the end bars 3 of the border element 1. At both ends of the support rod 8, or near its ends, is one shock absorber means 11, which is preferably disposed between the support rod 8 and the top bar 3*a* of the border element 1, to absorb horizontal and upward directed forces caused by a possible impact on the display element 4*b*. Preferably there is a shock absorber means 11 only on both ends of the support rod 8, so that one border element 1 only has two units of them, one at each end.

Correspondingly, the display panels 4*a* are supported at their lower part by a horizontal strut rod 9, each end of which is adapted to be supported by a second shock absorber 13 below the strut rod 9, the shock absorber being supported on a support means 14 fastened to the end bar 3 of the frame. Preferably the strut rod 9 is circular in its cross-section, e.g. a round tube. The lower part of the display panels 4*a* comprises two support means 10 extending backwards from the display panel 4*a* and fastened to the support frame 6 near its side edges. The lower edge of the support means 10 is provided with a round upwardly curved support surface, the radius of curvature of which is the same or greater than the radius of the outer surface of the strut rod 9, and which support surface is adapted to rest on the top surface of the strut rod 9. By virtue of the shape of its support surface, the support means 10 are adapted to prevent movement in the front-rear direction of the lower part of the display panels 4*a* as well as the downward movement of the display panels 4*a*.

Due to the circular cross-section of the strut rod 9 and the curved supporting surface of the support means 10, the display panel 4*a* is easy and quick to fasten into position when installing it and, if necessary, to detach. When detaching, for example, it is sufficient to detach only the suspension means 7 of the upper end from the support rod 8, in which case the display panel 4*a* can be turned backwards at its upper end around the strut rod 9 and lifted out of its position. Installation of a display panel into its position is performed in the reverse sequence.

Since the support means 10 is not fastened to the strut rod 9, the display panel 4*a* can, if necessary, also be moved sideways on the strut rod 9. This also facilitates and speeds up the installation and, if necessary, the replacement of e.g. a faulty display panel 4*a*.

Figure 4:
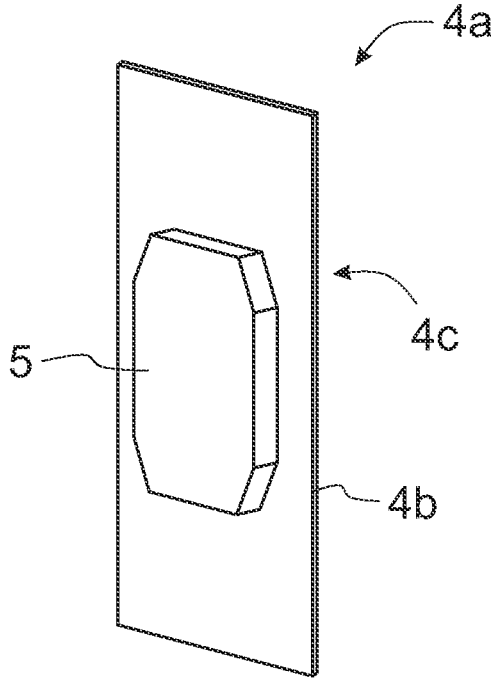
FIG. 4 presents a diagrammatic and simplified view of one display panel to be used in a border element according to an embodiment as viewed obliquely from the rear.

FIG. 4 presents one display panel 4*a* to be used in a border element 1 according to the invention, as viewed obliquely from the rear, without the support frame 6 and components fastened to it. A display panel 4*a* comprises, inter alia, a display element 4*b*, on the front side 4*c* of which is a display surface and on the rear side of which is an electronics unit 5 with control unit and control system.

FIG. 5 presents a partly simplified view of a magnified detail of an end of one border element 1 according to the invention, as viewed in the direction of the arrows along the section line A-A of FIG. 7. The figure clearly shows that the outer surface of the side edge 6*a* of the support frame 6, the side edge of the display element 4*b*, the side edge of the protective sheet 1*a* and the outer surface of the end bar 3 are all on the same straight line, i.e. on the same vertical plane in the operating position of the border element 1. This enables an essentially unitary display surface, on which the moving information flow can be seamlessly presented. The outer surface of the end bar 3 is the surface that faces the corresponding outer surface of the end bar of the adjacent border element 1. Correspondingly, the side edge of the display element 4*b* and the side edge of the protective sheet 1*a* are those edges that face the corresponding edges of the adjacent border element 1.

Figure 6:
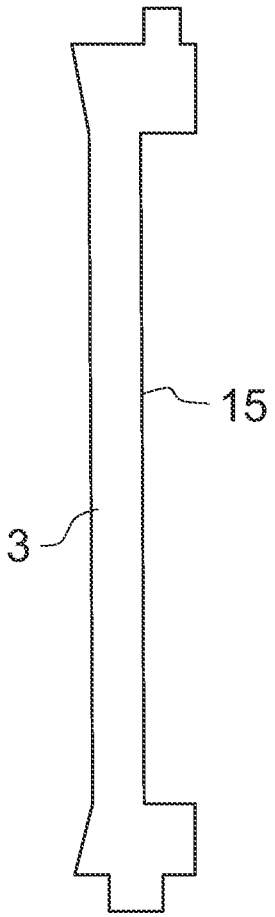
FIG. 6 presents a diagrammatic and simplified view of the end bar of the frame of a border element according to an embodiment.

FIGS. 6 and 7 present a diagrammatic and simplified view of one end bar 3 of the frame 2 of a border element 1 according to the invention and a border element 1 as viewed from the end. FIG. 6 presents just an end bar 3 and FIG. 7 presents a view of a border element 1 provided with display panels 4*a*, a protective sheet 1*a* and other components, wherein the end bar 3 is partially sectioned at its upper end.

Preferably the end bar 3 is fabricated from metal, by cutting and welding from steel plate, and by reinforcing the bar by bending the edges of the blank into a right angle with the end surface to be formed. In this case the bends of the end bars 3 in a finished frame 2 face each other.

On the front edge of both end bars 3 of the frame, in other words e.g. when a dasher board 1 is part of an ice hockey rink on the edge inside the rink, is a recess 15 extending from the front edge of the end bar 3 towards the rear edge, for situating the outermost side edges of the edgemost display panels 4*a* in the dasher board 1 on the same vertical plane as the outer surface of the end bar 3. The height of the recess 15 is then greater than, or equal to, the maximum height of the display panel 4*a* and the depth is dimensioned in such a way that there is an air gap 16 between the display surface on the front side 4*c* of the display element 4*b* and the protective sheet 1*a* in front of it. This air gap 16 both cools the display 4 and improves the impact resistance of the display element 4*b* because the distance of the front surface of the display element 4*b* to the surface of the protective sheet 1*a* increases. In this case even a hard impact on the protective sheet 1*a* does not bend the protective sheet 1*a* so much as to collide with the display surface of the display element 4*b*.

The basic color of the front surface of the display elements 4*b* and the display panels 4*a* is preferably white or light and arranged to operate in such a way that the points where the light sources of the display are not, at a certain moment, active appear white or light in the display. This improves e.g. the visual contrast of the black puck against the dasher board in hockey play.

It is obvious to the person skilled in the art that different embodiments of the invention are not limited to the example described above, but that they may be varied within the scope of the claims presented below. Thus, for example, the structure of the border elements can also be different than what is described above.

It is also obvious to the person skilled in the art that there can be display panels and/or display elements in one border element also one above another in addition to just one beside another, or both one above another and one beside another. It is also possible that there is only one display element, the area of the display surface of which covers the whole display area.

The invention claimed is:

1. A border element arrangement comprising two or more border elements abutting each other side-by-side, the two or more border elements comprising a frame provided with end bars and a structure connecting the end bars at least in a top part and a bottom part of the frame;

a digital display configured to be supported by the frame-, the digital display comprising one or more display panels configured to display a moving image;

a protective sheet in front of the digital display, wherein both end edges of the digital display are configured to extend to a same vertical plane as an outer surface of the end bars when positioned;

wherein the two or more border elements further comprise a horizontal support rod on which the one or more display panels are suspended from their upper ends; and on a front edge of the end bars is a recess, inside which the digital display is disposed at a point of the end bars.

2. The border element arrangement according to claim 1, wherein a total combined width of the two or more border elements and the two or more display panels is equal to a distance of outer surfaces of the end bars from each other.

3. The border element arrangement according to claim 1, wherein a height of the recess is greater than, or equal to, a maximum height of the two or more display panels, and a depth of the recess is dimensioned to form an air gap between a surface of the two or more display panels on a front side and the protective sheet in front of said surface.

4. The border element arrangement according to claim 1, wherein both end edges of the digital display are configured to extend at a point of the recess to a same plane as the outer surfaces of the end bars.

5. The border element arrangement according to claim 1, wherein outermost display panels of two adjacent border elements are fastened to each other in such a way that display surfaces of the one or more display panels are attached to each other at their end edges.

6. The border element arrangement according to claim 1, wherein the horizontal support rod is provided with a shock absorber, on which each of the one or more display panels is suspended from their upper ends.

7. The border element arrangement according to claim 1, wherein the two or more border elements further comprise a horizontal strut rod provided with a shock absorber, upon which rod each of the one or more display panels is supported at its lower end.

8. The border element arrangement according to claim 7, wherein each of the one or more display panels is supported at its lower end with support means resting on the horizontal strut rod, which support means are configured to prevent movement of the one or more display panels in a backward-forward direction as well as in a downward direction.

9. The border element arrangement according to claim 1, wherein on a rear surface of the one or more display panels is a support frame, via which the one or more display panels are fastened into position and one display panel is fastened to a support frame of a display panel next to it with fastening means.

* * * * *